US009068302B2

(12) United States Patent
Buhr et al.

(10) Patent No.: US 9,068,302 B2
(45) Date of Patent: Jun. 30, 2015

(54) MIXER BAR FOR A STABILIZER/RECYCLER

(75) Inventors: Karsten Buhr, Willroth (DE); Thomas Lehnert, Oberraden (DE); Cyrus Barimani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 715 days.

(21) Appl. No.: 13/251,535

(22) Filed: Oct. 3, 2011

(65) Prior Publication Data

US 2012/0086259 A1 Apr. 12, 2012

(30) Foreign Application Priority Data

Oct. 6, 2010 (DE) ..... 10 2010 038 016

(51) Int. Cl.

| | |
|---|---|
| ***E21C 35/18*** | (2006.01) |
| ***E21C 35/19*** | (2006.01) |
| ***E01C 21/00*** | (2006.01) |
| ***E01C 23/088*** | (2006.01) |

(52) U.S. Cl.
CPC ..... *E01C 21/00* (2013.01); *E01C 23/088* (2013.01)

(58) Field of Classification Search
USPC ..... 299/102–113, 95; D15/140; 404/90–94
See application file for complete search history.

(56) References Cited

U.S. PATENT DOCUMENTS

| | | | | |
|---|---|---|---|---|
| 3,285,668 | A * | 11/1966 | Fearon | 299/109 |
| 3,614,164 | A * | 10/1971 | Davis | 299/83.1 |
| 3,844,619 | A * | 10/1974 | Haller | 299/108 |
| 4,609,227 | A | 9/1986 | Wild et al. | |
| 4,621,871 | A | 11/1986 | Salani | |
| 4,693,518 | A | 9/1987 | Sulosky et al. | |
| 5,011,229 | A | 4/1991 | O'Neill et al. | |
| 5,125,720 | A * | 6/1992 | Salani | 299/107 |
| 5,322,351 | A | 6/1994 | Lent | |
| 5,370,448 | A | 12/1994 | Sterwerf, Jr. | |
| 5,378,050 | A | 1/1995 | Kammerer et al. | |
| 5,893,677 | A | 4/1999 | Haehn et al. | |
| 5,904,408 | A | 5/1999 | Olson et al. | |
| 6,152,648 | A | 11/2000 | Gfroerer et al. | |
| 6,685,273 | B1 * | 2/2004 | Sollami | 299/106 |
| 6,764,140 | B2 * | 7/2004 | Carson et al. | 299/79.1 |

(Continued)

FOREIGN PATENT DOCUMENTS

| | | | |
|---|---|---|---|
| AU | 639773 | B2 | 8/1993 |
| CN | 101091037 | A | 12/2007 |

(Continued)

OTHER PUBLICATIONS

Design U.S. Appl. No. 29/419,715, filed May 1, 2012 to Buhr et al.

(Continued)

*Primary Examiner* — Sunil Singh
(74) *Attorney, Agent, or Firm* — Lucian Wayne Beavers; Patterson Intellectual Property Law, PC

(57) ABSTRACT

The invention relates to a mixer bar for a stabilizer/recycler, having an attachment side that comprises an attachment surface for mounting on a drum surface, and having a tool holder receptacle. A mixer bar of this kind can be configured in wear- and strength-optimized fashion, with little production outlay, if provision is made that the mixer bar is embodied as a forged part and has a cross-sectional profile that varies at least locally transversely to the tool feed direction.

41 Claims, 3 Drawing Sheets

(56) References Cited

U.S. PATENT DOCUMENTS

| | | | |
|---|---|---|---|
| 7,338,134 | B2 | 3/2008 | Latham |
| 7,547,075 | B2 | 6/2009 | Tewes et al. |
| 7,784,875 | B2 | 8/2010 | Holl et al. |

FOREIGN PATENT DOCUMENTS

| | | | |
|---|---|---|---|
| DE | 8512938 | U1 | 7/1985 |
| DE | 3636816 | A1 | 5/1988 |
| DE | 9211739 | U1 | 12/1992 |
| DE | 4206994 | A1 | 9/1993 |
| DE | 4417846 | A1 | 12/1994 |
| DE | 19504495 | A1 | 8/1996 |
| DE | 29711566 | U1 | 9/1997 |
| DE | 19833466 | A1 | 1/1999 |
| EP | 0200037 | A2 | 11/1986 |
| EP | 1790817 | A1 | 5/2007 |
| EP | 2048323 | A1 | 4/2009 |
| WO | 2005100748 | A1 | 10/2005 |

OTHER PUBLICATIONS

Design U.S. Appl. No. 29/419,718, filed May 1, 2012 to Buhr et al.
Reference OV1 in Opposition Proceeding dated Nov. 16, 2012, filed against corresponding German Application DE 102010038016, 1 page.
Reference OV2 in Opposition Proceeding dated Nov. 16, 2012, filed against corresponding German Application DE 102010038016, 1 page.
Reference OV3 in Opposition Proceeding dated Nov. 16, 2012, filed against corresponding German Application DE 102010038016, 1 page.
Reference OV4 in Opposition Proceeding dated Nov. 16, 2012, filed against corresponding German Application DE 102010038016, 1 page.
Reference OV5 in Opposition Proceeding dated Nov. 16, 2012, filed against corresponding German Application DE 102010038016, 1 page.
Reference OV6 in Opposition Proceeding dated Nov. 16, 2012, filed against corresponding German Application DE 102010038016, 2 pages.
Reference OV7 in Opposition Proceeding dated Nov. 16, 2012, filed against corresponding German Application DE 102010038016, 1 page.
Reference OV8 in Opposition Proceeding dated Nov. 16, 2012, filed against corresponding German Application DE 102010038016, 1 page.
Reference OV9 in Opposition Proceeding dated Nov. 16, 2012, filed against corresponding German Application DE 102010038016, 1 page.
Reference OV10 in Opposition Proceeding dated Nov. 16, 2012, filed against corresponding German Application DE 102010038016, 1 page.
Reference OV11 in Opposition Proceeding dated Nov. 16, 2012, filed against corresponding German Application DE 102010038016, 1 page.
Reference OV12 in Opposition Proceeding dated Nov. 16, 2012, filed against corresponding German Application DE 102010038016, 1 page.
Reference OV13 in Opposition Proceeding dated Nov. 16, 2012, filed against corresponding German Application DE 102010038016, 1 page.
Reference OV14 in Opposition Proceeding dated Nov. 16, 2012, filed against corresponding German Application DE 102010038016, 1 page.
Reference OV15 in Opposition Proceeding dated Nov. 16, 2012, filed against corresponding German Application DE 102010038016, 7 pages.
Reference OV16 in Opposition Proceeding dated Nov. 16, 2012, filed against corresponding German Application DE 102010038016, 4 pages.
Reference OV17 in Opposition Proceeding dated Nov. 16, 2012, filed against corresponding German Application DE 102010038016, 1 page.
Reference OV18 in Opposition Proceeding dated Nov. 16, 2012, filed against corresponding German Application DE 102010038016, 2 pages.
Reference OV19 in Opposition Proceeding dated Nov. 16, 2012, filed against corresponding German Application DE 102010038016, 2 pages.
Opposition of Nov. 16, 2012 filed against German priority application DE 102010038016, 30 pages.
Response filed by BOMAG GmbH in German opposition proceeding to corresponding German patent, response being dated Jan. 2, 2014, 14 pp.
Response filed by BOMAG GmbH in German opposition proceeding to corresponding German patent, response being dated Mar. 10, 2014, 14 pp.
E16: Broschüre "WR 2500 S—der Recycler der neuen Generation" der Patentinhaberin.
E17: Broschüre "Recycler WR 2000—Kompakt in den Abmessungen, groβ in der Leistung" der Patentinhaberin.
Wirtgen Group "Recyceln and Frasen mit einer Maschine Kaltrecycler 2200 CR" brochure, Wirtgen GmbH, Germany, 33 pp.

* cited by examiner

MIXER BAR FOR A STABILIZER/RECYCLER

The present invention relates to a mixer bar for a stabilizer/recycler, having an attachment side that comprises an attachment surface for mounting on a drum surface, and having a tool holder receptacle.

Stabilizers are construction machines that are used to consolidate a more or less loose substrate. Consolidation serves in this context as preparation for a structure that is to be built, for example a road or a building. Recyclers, on the other hand, are used when the task involves regenerating an existing dilapidated traffic surface. The core element of a stabilizer/recycler is a mixer drum. This is made up of a milling drum rotor on whose drum surface mixer bars are mounted (usually welded) in distributed fashion. The mixer bars carry a tool holder receptacle spaced away from the drum surface. Either a tool holder or a quick change tool holder system having a tool is inserted into said receptacle. During operational use, the tool penetrates into the dirt being processed, and cuts it up. The mixer bar digs into the cut-up dirt and thus contributes to loosening. A binder is introduced into the loosened dirt and serves to consolidate it. This binder is mixed with the cut-up dirt as a result of the mixer bars and their systematic arrangement on the drum surface, in conjunction with the rotation of the milling drum.

The mixer bars are produced as flame-cut parts, the desired contour of the mixer bar being cut out of a metal sheet using a cutting torch.

In order to minimize the necessary machine power output, the mixer bars are embodied to be relatively narrow. They nevertheless present considerable penetration resistance. In addition, the mixer bars become worn as a result of the material flowing past. Once they have reached their wear limit, they must be removed from the drum surface and replaced with a new mixer bar.

It is an object of the invention to create a mixer bar of the kind mentioned above that makes possible an efficiency-optimized design along with ease of manufacture.

This object of the invention is achieved in that the mixer bar is embodied as a forged part and has a cross-sectional profile that varies at least locally transversely to the tool feed direction. By way of the varying cross-sectional profile, it is possible to generate a shape that achieves low levels of penetration resistance into the dirt. The shape of the mixer bar can, in this context, be designed in a manner adapted to the flow of the material being detached, thereby decreasing wear and at the same time improving the mixing result. In addition, by way of the varying cross-sectional profiles it is possible to embody protective zones that, for example, protect a tool holder or a quick-change tool holder system from the abrasive attack of the detached material. Simple production of the mixer part is furthermore achieved, since it is embodied as a forged part. The varying cross-sectional profiles can be achieved here without additional mechanical processing. In addition, forged parts offer the possibility of using material having excellent strength and toughness properties, and are therefore ideally suited for the present application.

According to a preferred variant embodiment of the invention, provision is made that the attachment side comprises a divided or continuous mounting surface that transitions at least locally, via a recess or bevel serving as a weld-bead preparation, into lateral surfaces that are at an angle to the mounting surface. The weld-bead preparations can already be shaped upon production of the forged part, so that no additional mechanical processing is necessary here. Upon installation of the mixer bar on the drum surface, the weld-bead preparation can be filled with additional weld material.

A mixer bar according to the present invention can be such that the mounting surface comprises, on the oppositely located mixer bar sides, mounting edges that each extend in the tool feed direction and each taper, at their front and/or rear ends, into end segments extending at an angle to the tool feed direction. These mounting edges can once again easily be implemented on the forged part. They have the advantage that energy transfer from the mixer bar into the drum surface is optimized, since large discontinuities in stiffness are avoided and the weld beads do not extend parallel to the grain of the milling drum rotor. The risk of damage to the milling drum rotor in a context of severe stress on the mixer bar is thereby minimized. This effect can be achieved in particularly simple fashion if provision is made that the end segments of the mounting edges form arrow-shaped tapers. In particular, the mounting edges can be incident so that a symmetry is produced and so that symmetrical loading values can thus also be achieved.

According to a further variant of the invention, provision can be made that there is arranged on the front side of the bar a mixer segment that is delimited laterally by two flank surfaces arranged at an angle to one another, the flank surfaces being incident to each other in an arrow shape. This kind of configuration of the mixer segment can likewise be implemented in simple fashion on the forged part.

With the laterally incident flank surfaces, the penetration resistance of the mixer bar into the substrate being processed is greatly reduced. This results in a decrease in the required motor drive power output of the stabilizer/recycler, and thus in greater efficiency. If the flank surfaces are embodied asymmetrically, the mixing result can moreover be improved.

A mixer bar according to the present invention can be characterized in that a protrusion is arranged in front of the tool holder receptacle in the tool feed direction. This protrusion protects the quick-change tool holder system or tool holder located behind it from the abrasive attack of the detached material. In particular, the protrusion can also be adapted, in terms of its width extending transversely to the tool feed direction, to the shape of the tool holder or quick-change tool holder system located behind it. The protrusion can likewise be delimited by two flank surfaces that decrease the penetration resistance of the mixer bar. In particular, the flank surfaces of the protrusion can also be constituted by the flank surfaces of the mixer segment, thus producing a continuous geometry that promotes the flow of material.

If provision is made that the tool holder receptacle is delimited, oppositely to the tool feed direction, by a supporting projection, this then results in a stable positive support, rigid oppositely to the tool feed direction, for the tool holder or quick-change tool holder system arranged in the holder receptacle.

In order to achieve a high level of dimensional stability in the tool holder receptacle, provision can be made that the protrusion and the supporting projection are connected to one another by means of a connecting segment. The connecting segment ensures positional association of the protrusion with respect to the supporting projection, in particular as the forged part cools during production.

Weight optimization of the mixer bar can be achieved in simple fashion by the fact that the connecting segment is constricted in its cross-sectional geometry with recesses and/or that an aperture or at least one hollow-shaped depression is introduced into the mixer bar in the region between the tool holder receptacle and the mounting surface. These reductions in material serve to decrease inertia and thus to reduce the required drive power output of the drive unit.

If provision is made that two shaped surfaces extend on the oppositely located mixer bar sides from the tool holder receptacle toward the front side of the mixer bar and at an angle to the tool feed direction, a geometry promoting the flow of material is then created. The shaped surfaces, in particular, prevent eroded areas from forming.

Another subject of the invention is a mixer bar having a tool holder that comprises a tool receptacle and is connected to the mixer bar. Provision can be made in particular, in this context, that the tool holder is made up of a lower part and an upper part, the lower part being connected to the mixer bar, and the upper part being connected replaceably to the lower part. The lower part can, in particular, be welded to the mixer bar. The upper part and lower part can be held with respect to one another by way of a screw connection. Positively and/or frictionally engaged connections are also conceivable. The upper part comprises a tool receptacle for replaceable reception of a tool, for example a shank bit, in particular a round shank bit. It is nevertheless apparent to one skilled in the art that the invention is not limited to the use of specific tool holders and tools. All imaginable tool holder and tools can instead be utilized. A wear system is thereby created. In this context, the tool has the shortest lifetime and can easily be replaced once the wear limit is reached. The upper part has a service life corresponding to several times that of a tool. It, too, can easily be changed once its wear limit is reached.

The upper part serves, in combination with the mixer bar, to protect the lower part, which is relatively costly to produce and therefore has the longest lifetime of the quick-change tool holder system. Optimally, the lifetime of the lower part is adapted to the lifetime of the mixer bar, so that this component unit can be replaced together once the wear limit is reached.

The invention will be further explained below with reference to an exemplifying embodiment depicted in the drawings, in which.

Figure 1:
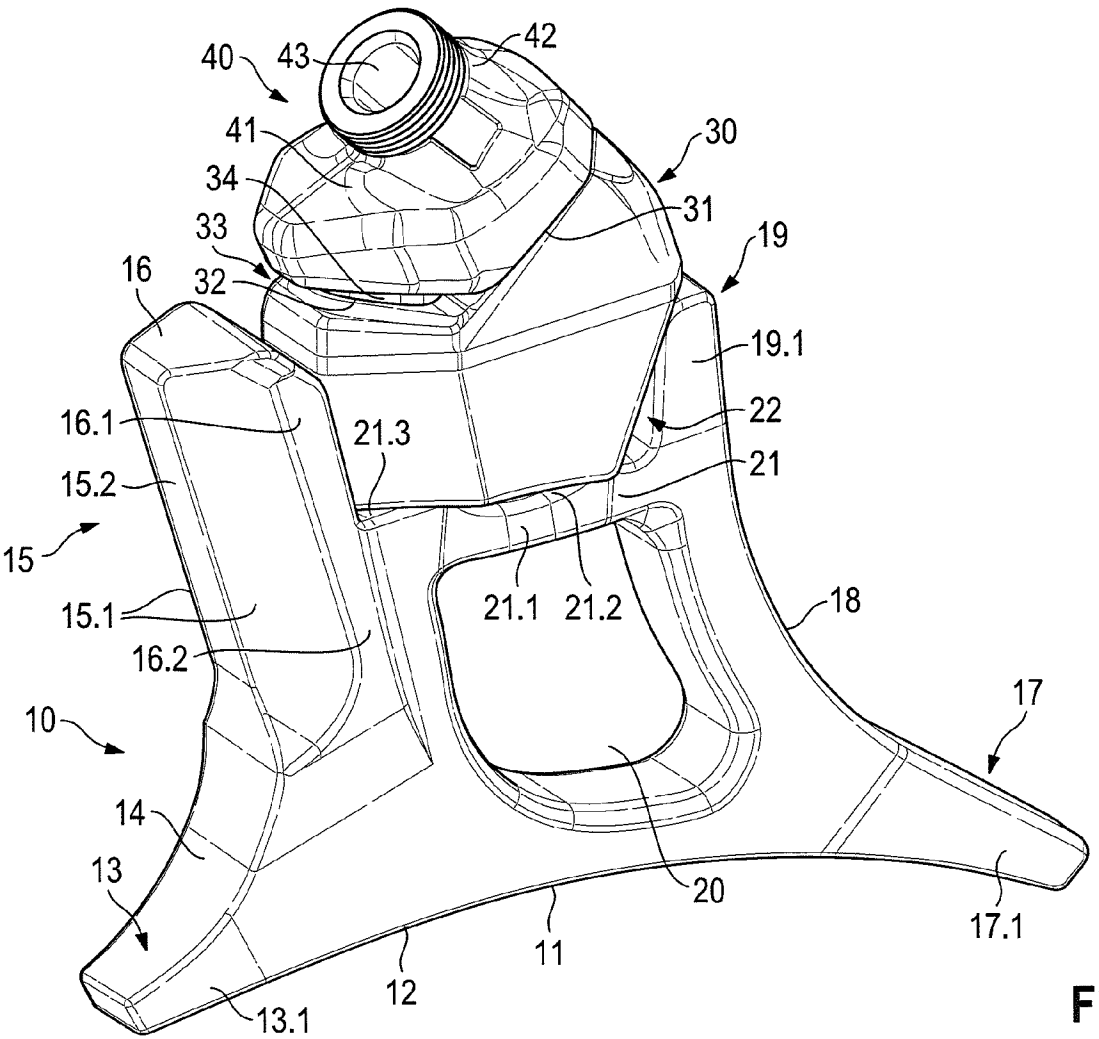
FIG. 1 is a perspective side view of a mixer bar with a tool holder.

FIG. 1 shows a mixer bar or mixer bar body 10 that is made, as a forged part, from a steel material. The forged part shown is usable directly, without mechanical post-processing. Mixer bar 10 comprises a lower concavely curved mounting surface 11, mounting surface 11 being adapted to the outer contour of drum surface W (see FIG. 2) of a milling rotor. The continuous mounting surface 11 is delimited at the edges by a peripheral bevel 12. This bevel 12 serves as a weld-bead preparation. Bevel 12 thus forms mounting edges that can be filled with additional weld material in order to connect mixer bar 10 to drum surface W. The mounting edges extend parallel to one another in the center region of mounting surface 11, and are constituted by the oppositely located lateral surfaces of mixer bar 10 that extend in tool feed direction V. A front-side protrusion 13 is provided on the front side of mixer bar 10, and a rear-side protrusion 17 on the rear side.

Figure 3:
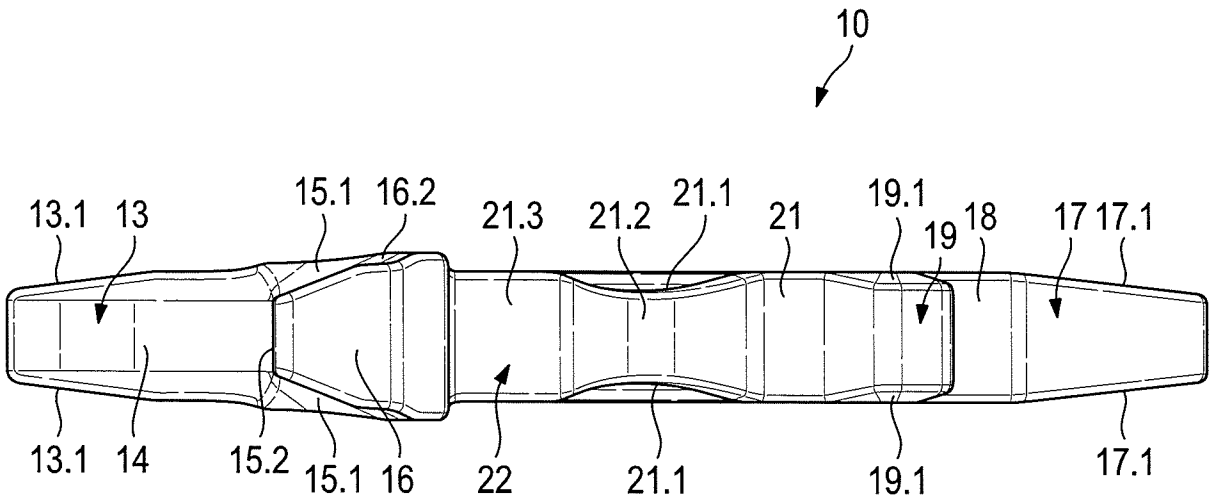
FIG. 3 is a plan view of the mixer bar according to FIGS. 1 and 2, without the tool holder.

As may be seen clearly especially from FIG. 3, protrusions 13, 17 are delimited by lateral surfaces 13.1, 17.1, which are incident at an angle to tool feed direction V and are arranged with respect to one another in an arrow shape. This creates mounting edges that are incident transversely to tool feed direction V on the front and rear side of mixer bar 10. This incidence prevents the weld beads from running parallel to the grain direction of drum surface W over their entire length and in particular in the region of the greatest operating stresses, thereby increasing operational strength. A further result of this incidence, however, is that discontinuities in stiffness between mixer bar 10 and drum surface W are decreased, and the risk of breakage thereby further diminished. Protrusion 13 may be referred to as a front side base protrusion. Protrusion 17 may be referred to as a rear side base protrusion. Protrusion 13 is transitioned, via a radius transition 14 of concave embodiment, into a mixer segment 15. Mixer segment 15 comprises a cutting edge 15.2 embodied as a bar segment. This cutting edge 15.2 transitions laterally into flank surfaces 15.1. Flank surfaces 15.1 extend on both sides of cutting edge 15.2 symmetrically with respect thereto, but can also be arranged asymmetrically. They are incident in an arrow shape at an angle to tool feed direction V and transition, at their side facing away from tool feed direction V, into shaped surfaces 16.1. Shaped surfaces 16.1 are once again inclined at an angle to tool feed direction V, although the slope extends oppositely to flank surfaces 15.1.

When reference is made herein to a cross-sectional profile transverse to the tool feed direction, that is a reference to the width or thickness of the mixer bar across its narrower dimension. For example, referring to FIG. 3 the distance between two opposed flank surfaces such as 15.1 would be the width or thickness transverse to the tool feed direction. Because in many locations on the forged part such opposed surfaces are not parallel to each other, this width or thickness varies in those locations. Thus the cross-sectional profile varies at least locally transversely to a tool feed direction. As seen in FIG. 3, that variation can be along either the height or the length of the mixer bar, or both.

Mixer segment 15 comprises a protrusion 16 that is arranged in front of a tool holder receptacle 22 in tool feed direction V. Flank surfaces 15.1 extend continuously over protrusion 16 so that a continuous cutting edge 15.2 and continuous flank surfaces 15.1 are obtained. Protrusion 16 may be referred to as a cutting protrusion. Shaped surface 16.1 transitions in the lower region of mixer segment 15, by means of transition segments 16.2, into lateral surfaces 13.1, 17.1 of mixer bar 10. In the region of protrusion 16, shaped surfaces 16.1 are transitioned into tool receptacle 22.

The rear-side protrusion 17 transitions via a radius transition 18 into a rearward supporting protection 19. Supporting projection 19 delimits tool receptacle 22 at the rear side. Supporting projection 19 is delimited laterally be two mutually parallel cheekpieces 19.1. Tool receptacle 22 is thus embodied between protrusion 16 and supporting projection 19.

Tool receptacle 22 is delimited toward the bottom by means of a connecting segment 21. Connecting segment 21 connects supporting projection 19 to mixer segment 15 and/or to protrusion 16. Connecting segment 21 forms a seating surface 21.3 that extends substantially in tool feed direction V. Hollow-shaped recesses 21.2 are recessed into said seating surface 21.3. In addition, recesses 21.1 are also cut out of the lateral surfaces of connecting segment 21 that perpendicularly adjoin seating surface 21.3. These recesses 21.1. and 21.2 serve for weight reduction. Connecting segment 21 stiffens supporting projection 19 with respect to protrusion 16 so that the dimensional stability of these two components with respect to one another is guaranteed with no need for mechanical post-processing.

An aperture 20 that serves for weight reduction is introduced below connecting segment 21 and above mounting surface 11, in the intermediate region of mixer bar 10. Instead of aperture 20, it is also possible to provide recesses on both sides of the forged part, a thin wall of mixer bar 10 then remaining instead of aperture 20. A configuration of this kind prevents detached fragments, for example larger stones, from becoming wedged into aperture 20 and possibly limiting functionality.

A monolithic tool holder having a tool holder 43 for replaceable reception of a tool, in particular a round shank bit, can be welded into tool holder receptacle 22. What is used in the present exemplifying embodiment as a tool holder is not a monolithic but instead a two-part quick-change tool holder system. This tool holder is made up of a lower part 30 and an upper part 40. Lower part 30 can be inserted into tool holder receptacle 22 in such a way that front- and rear-side attachment surfaces 38 are associated with protrusion 16 and with rear-side supporting projection 19, respectively. At the same time, lower part 30 sits with a bottom surface 35 on seating surface 21.3 of connecting segment 21. The association between lower part 30 and mixer bar 10 is more clearly evident from FIG. 2. Once inserted, lower part 30 can be welded in the region of its attachment surfaces 38 to protrusion 16 and to supporting projection 19. In the region of its bottom surface 35, lower part 30 is welded to connecting portion 21.

Lower part 30 comprises a contact surface 31 that transitions in angular fashion into a setback 32. Lower part 30 is prepared for reception of upper part 40. It comprises an insertion receptacle into which an insertion extension of upper part 40 can be inserted. This insertion extension can be secured with a clamping screw threaded into lower part 30, upper part 40 being pulled with a mating surface onto contact surface 31 and immobilized there. In the installed state, setback 32 is at a distance from an oppositely located surface of upper part 40 so that a resetting space 33 is formed. This resetting space 33 is spanned by a seal 34 made of elastic material. Seal 34 prevents penetration of detached material into the region between upper part 40 and lower part 30. Upper part 40 is equipped with a tool receptacle 43 embodied as an orifice, as is clearly evident from FIG. 1. A round shank bit can be installed replaceably into this tool receptacle 43. The tip of the round shank bit intersects the cutting circle labeled "S" in FIG. 2. Tool receptacle 43 is introduced into an extension 42 of upper part 40. Extension 40 is shaped integrally onto a base part 41 of upper part 40.

Figure 2:
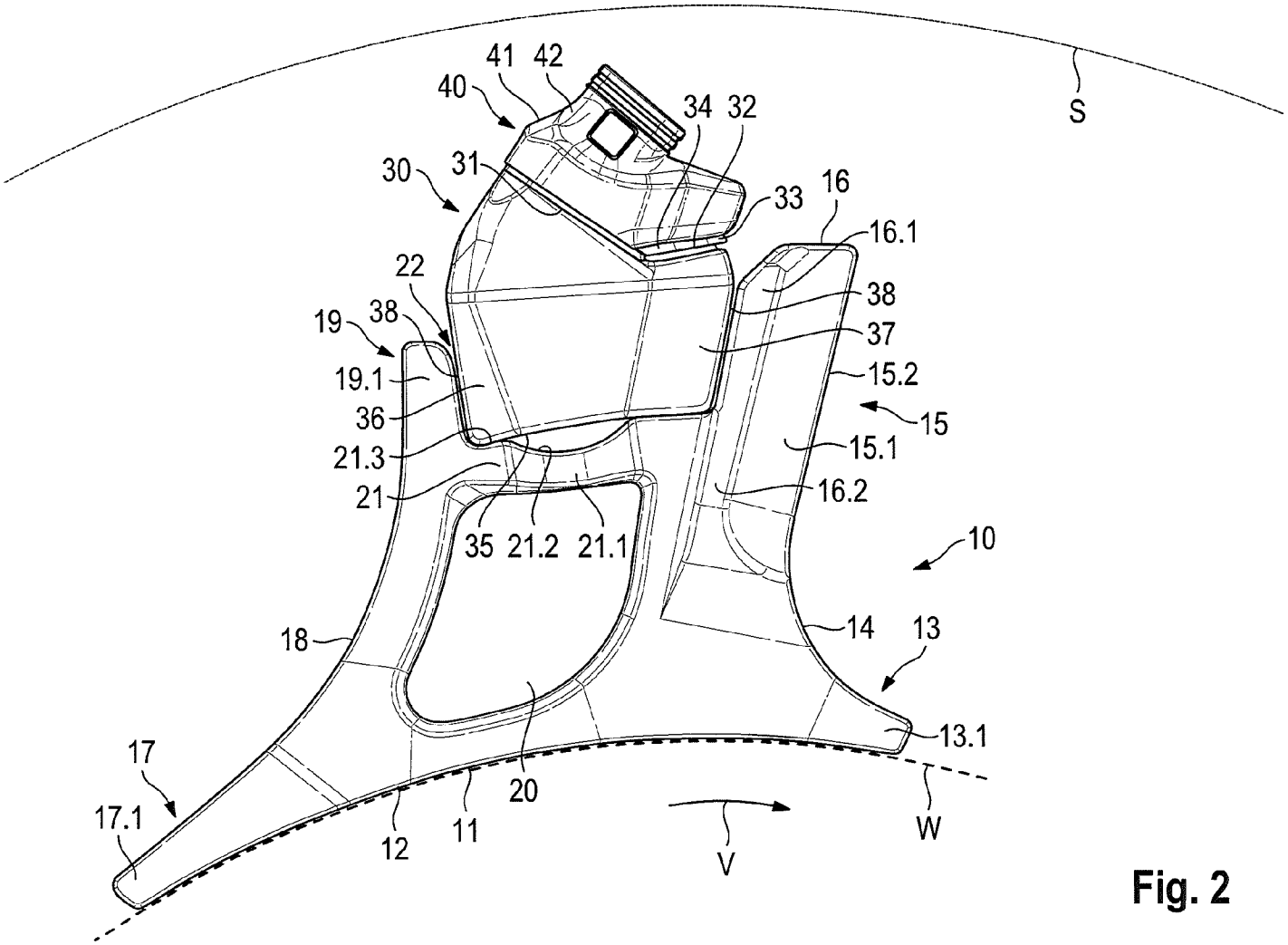
FIG. 2 is a side view of what is depicted in FIG. 1.

As may be gathered from FIGS. 1 and 2, shaped surfaces 16.1 of mixer bar 10 transition into front-side oblique surfaces 37 of lower part 30. Oblique surfaces 37 are present on both sides of lower part 30, and are incident to one another in arrow-shaped fashion. In addition, further oblique surfaces 36, which transition into cheekpieces 19.1 of supporting projection 19, are arranged at the rear on both sides of lower part 30. An optimization of the flow of material is achieved with oblique surfaces 36, 37.

What is claimed is:

1. A mixer bar for a stabilizer/recycler, wherein the mixer bar is embodied as a forged part and has a cross-sectional profile that varies at least locally transversely to a tool feed direction, the mixer bar having a length defined by the mounting surface, a height extending transversely to the mounting surface, and a lateral width extending transversely to both the length and the height, the lateral width being narrower than both the length and the height;

wherein the mixer bar further includes:

an attachment side including a mounting surface for mounting on a drum surface;

a tool holder receptacle; and a protrusion arranged in front of the tool holder receptacle in the tool feed direction, the protrusion having a greater width, transversely to the tool feed direction, than a region adjoining behind the protrusion.

2. The mixer bar according to claim 1, wherein the mounting surface transitions at least locally, via a recess or bevel serving as a weld-bead preparation, into lateral surfaces that are at an angle to the mounting surface.

3. The mixer bar according to claim 2, wherein the mounting surface comprises a divided mounting surface.

4. The mixer bar according to claim 2, wherein the mounting surface comprises a continuous mounting surface.

5. The mixer bar according to claim 1, wherein the mounting surface comprises, on oppositely located mixer bar sides, mounting edges that each extend in the tool feed direction and each taper, at their front and/or rear ends, into end segments extending at an angle to the tool feed direction.

6. The mixer bar according to claim 5, wherein the end segments of the mounting edges form arrow-shaped tapers.

7. The mixer bar according to claim 1, further comprising a front side of the bar including a mixer segment delimited laterally by two flank surfaces, the flank surfaces being arranged at an angle to one another in an arrow shape.

8. The mixer bar according to claim 1, wherein the protrusion is delimited by two flank surfaces that are inclined to one another in an arrow shape.

9. The mixer bar according to claim 1, wherein the tool holder receptacle is delimited, oppositely to the tool feed direction, by a supporting projection.

10. The mixer bar according to claim 9, wherein the protrusion and the supporting projection are connected by a connecting segment.

11. The mixer bar according to claim 10, wherein the connecting segment is constricted in its cross-sectional geometry with one or more recesses.

12. The mixer bar according to claim 1, further comprising at least one recess defined in the mixer bar in a region between the tool holder receptacle and the mounting surface.

13. The mixer bar according to claim 12, wherein the at least one recess comprises an aperture extending through the mixer bar.

14. The mixer bar according to claim 12, wherein the at least one recess comprises at least one hollow shaped depression defined in the mixer bar.

15. The mixer bar according to claim 1, further comprising two shaped surfaces extending on oppositely located mixer bar sides from the tool holder receptacle toward a front side of the mixer bar and at an angle to the tool feed direction.

16. The mixer bar according to claim 1, in combination with a tool holder comprising a tool receptacle and connected to the mixer bar.

17. The mixer bar according to claim 16, wherein the tool holder is made up of a lower part and an upper part, the lower part being connected to the mixer bar, and the upper part being connected replaceably to the lower part, and the upper part comprising the tool receptacle.

18. A mixer bar, comprising:

a forged mixer bar body having a length extending in a tool feed direction, a height extending transverse to the length, and a lateral width extending transversely to both the tool feed direction and the height, the lateral width being narrower than the length and the height, including;

an arcuate mounting surface configured to mount the body on a drum surface;

a receptacle defined in the body and including a seat configured to receive a tool holder, the seat being located above the arcuate mounting surface by a distance greater than the lateral width of the mixer bar body; and a cutting protrusion located in front of the receptacle in a tool feed direction, the cutting protrusion partially defining the receptacle, the cutting protrusion being tapered in the tool feed direction to define a cutting edge.

19. The mixer bar of claim 18, wherein:

the body further includes a front side base protrusion adjacent the mounting surface and tapered in the tool feed direction, the front side base protrusion protruding forward of the cutting protrusion.

20. The mixer bar of claim 19, wherein:

the body further includes a radius transition joining the front side base protrusion with the cutting edge.

21. The mixer bar of claim 19, wherein:

the body further includes a rearward supporting projection located behind the receptacle and partially defining the receptacle; and the body further includes a rear side base protrusion adjacent the mounting surface and tapered opposite to the tool feed direction, the rear side base protrusion protruding rearward of the rearward supporting projection.

22. The mixer bar of claim 18, wherein:

the body further includes a rearward supporting projection located behind the receptacle and partially defining the receptacle.

23. The mixer bar of claim 22, wherein:

the cutting protrusion has a lateral width immediately in front of the receptacle greater than a lateral width of the rearward supporting projection immediately behind the receptacle.

24. The mixer bar of claim 22, wherein:

the body further includes a connecting segment joining the cutting protrusion and the rearward supporting projection, the connecting segment having a seating surface defined thereon, the seating surface partially defining the receptacle.

25. The mixer bar of claim 24, wherein:

the body further includes a recess defined in the body between the connecting segment and the mounting surface.

26. The mixer bar of claim 25, wherein:

the recess comprises an aperture defined laterally through the body.

27. The mixer bar of claim 18, in combination with a tool holder welded in place in the receptacle.

28. The mixer bar of claim 27, wherein:

the tool holder includes a lower part welded to the mixer bar, and an upper part replaceably received in the lower part.

29. A method of manufacturing a mixer bar, comprising:

forging a mixer bar body having a length extending in a tool feed direction, a height extending transverse to the length, and a lateral width extending transversely to both the tool feed direction and the height, the lateral width being narrower than the length and the height, the mixer bar body including:

an arcuate mounting surface configured to mount the body on a drum surface;

a receptacle defined in the body and including a seat configured to receive a tool holder, the seat being located above the arcuate mounting surface by a distance greater than the lateral width of the mixer bar body; and a cutting protrusion located in front of the receptacle in a tool feed direction, the cutting protrusion partially defining the receptacle, the cutting protrusion being tapered in the tool feed direction to define a cutting edge.

30. The method of claim 29, wherein:

the body further includes a front side base protrusion adjacent the mounting surface and tapered in the tool feed direction, the front side base protrusion protruding forward of the cutting protrusion.

31. The method of claim 30, wherein:

the body further includes a radius transition joining the front side base protrusion with the cutting edge.

32. The method of claim 30, wherein:

the body further includes a rearward supporting projection located behind the receptacle and partially defining the receptacle; and the body further includes a rear side base protrusion adjacent the mounting surface and tapered opposite to the tool feed direction, the rear side base protrusion protruding rearward of the rearward supporting projection.

33. The method of claim 29, wherein:

the body further includes a rearward supporting projection located behind the receptacle and partially defining the receptacle.

34. The method of claim 33, wherein:

the cutting protrusion has a lateral width immediately in front of the receptacle greater than a lateral width of the rearward supporting projection immediately behind the receptacle.

35. The method of claim 33, wherein:

the body further includes a connecting segment joining the cutting protrusion and the rearward supporting projection, the connecting segment having a seating surface defined thereon, the seating surface partially defining the receptacle.

36. The method of claim 35, wherein:

the body further includes a recess defined in the body between the connecting segment and the mounting surface.

37. The method of claim 36, wherein:

the recess comprises an aperture defined laterally through the body.

38. A mixer bar, comprising:

a forged mixer bar body, including;

an arcuate mounting surface configured to mount the body on a drum surface;

a receptacle defined in the body and configured to receive a tool holder;

a cutting protrusion located in front of the receptacle in a tool feed direction, the cutting protrusion partially defining the receptacle, the cutting protrusion being tapered in the tool feed direction to define a cutting edge;

a front side base protrusion adjacent the mounting surface and tapered in the tool feed direction, the front side base protrusion protruding forward of the cutting protrusion; and a radius transition joining the front side base protrusion with the cutting edge.

39. A mixer bar, comprising:

a forged mixer bar body, including;

an arcuate mounting surface configured to mount the body on a drum surface;

a receptacle defined in the body and configured to receive a tool holder;

a cutting protrusion located in front of the receptacle in a tool feed direction, the cutting protrusion partially defining the receptacle, the cutting protrusion being tapered in the tool feed direction to define a cutting edge;

a front side base protrusion adjacent the mounting surface and tapered in the tool feed direction, the front side base protrusion protruding forward of the cutting protrusion;

a rearward supporting projection located behind the receptacle and partially defining the receptacle; and a rear side base protrusion adjacent the mounting surface and tapered opposite to the tool feed direction, the rear side base protrusion protruding rearward of the rearward supporting projection.

40. A method of manufacturing a mixer bar, comprising:

forging a mixer bar body including:

an arcuate mounting surface configured to mount the body on a drum surface;

a receptacle defined in the body and configured to receive a tool holder;

a cutting protrusion located in front of the receptacle in a tool feed direction, the cutting protrusion partially defining the receptacle, the cutting protrusion being tapered in the tool feed direction to define a cutting edge;

a front side base protrusion adjacent the mounting surface and tapered in the tool feed direction, the front side base protrusion protruding forward of the cutting protrusion; and a radius transition joining the front side base protrusion with the cutting edge.

41. A method of manufacturing a mixer bar, comprising:

forging a mixer bar body including:

an arcuate mounting surface configured to mount the body on a drum surface;

a receptacle defined in the body and configured to receive a tool holder;

a cutting protrusion located in front of the receptacle in a tool feed direction, the cutting protrusion partially defining the receptacle, the cutting protrusion being tapered in the tool feed direction to define a cutting edge;

a front side base protrusion adjacent the mounting surface and tapered in the tool feed direction, the front side base protrusion protruding forward of the cutting protrusion;

a rearward supporting projection located behind the receptacle and partially defining the receptacle; and a rear side base protrusion adjacent the mounting surface and tapered opposite to the tool feed direction, the rear side base protrusion protruding rearward of the rearward supporting projection.

* * * * *